US009111676B2

(12) United States Patent
Ler et al.

(10) Patent No.: US 9,111,676 B2
(45) Date of Patent: Aug. 18, 2015

(54) PARALLEL STACKED SYMMETRICAL AND DIFFERENTIAL INDUCTOR

(71) Applicant: Silterra Malaysia Sdn. Bhd., Kulim, Kedah (MY)

(72) Inventors: Chun Lee Ler, Tangkak (MY); Mohd Hafis Mohd Ali, Jelebu (MY); Yusman Yusof, Kulim (MY); Subhash Chander Rustagi, Jalan Pangkor (MY)

(73) Assignee: Silterra Malaysia Sdn. Bhd., Kulim (MY)

( * ) Notice: Subject to any disclaimer, the term of this patent is extended or adjusted under 35 U.S.C. 154(b) by 0 days.

(21) Appl. No.: 13/797,073

(22) Filed: Mar. 12, 2013

(65) Prior Publication Data

US 2013/0249660 A1 Sep. 26, 2013

(30) Foreign Application Priority Data

Mar. 26, 2012 (MY) ..... PI 2012700119

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 41/04*** | (2006.01) |

(52) U.S. Cl.

CPC ..... *H01F 17/0013* (2013.01); *H01F 41/041* (2013.01); *H01F 2017/0046* (2013.01)

(58) Field of Classification Search

USPC ..... 336/200, 232

See application file for complete search history.

(56) References Cited

U.S. PATENT DOCUMENTS

| | | | | |
|---|---|---|---|---|
| 7,400,025 | B2 * | 7/2008 | Pitts et al. | 257/531 |
| 2004/0075521 | A1 * | 4/2004 | Yu et al. | 336/200 |
| 2007/0267718 | A1 * | 11/2007 | Lee | 257/531 |
| 2008/0012678 | A1 * | 1/2008 | Lee | 336/200 |
| 2008/0174394 | A1 * | 7/2008 | Lee | 336/69 |
| 2010/0295648 | A1 * | 11/2010 | Huang et al. | 336/200 |

FOREIGN PATENT DOCUMENTS

EP 655628 A2 * 5/1995

* cited by examiner

*Primary Examiner* — Tsz Chan

(74) *Attorney, Agent, or Firm* — Christensen O'Connor Johnson Kindness PLLC

(57) ABSTRACT

A parallel stacked symmetrical and differential inductor and manufacturing method of the same is disclosed. The parallel stacked symmetrical and differential inductor is disposed on a substrate and comprises at least one first conductive layer (202, 204) disposed on an insulating layer and at least one subsequent conductive layer (206, 208) disposed on a plurality of insulating layers stacked under the at least one first conductive layer (202, 204). The at least one first conductive layer (202, 204) and each of the at least one subsequent conductive layer (206, 208) are electrically connected by a first plurality of conductive plugs (214) in a winding region (104). Each of the at least one subsequent conductive layer (206, 208) are electrically connected by a second plurality of conductive plugs (212) in a bridge region (102).

5 Claims, 3 Drawing Sheets

PARALLEL STACKED SYMMETRICAL AND DIFFERENTIAL INDUCTOR

CROSS-REFERENCE TO RELATED APPLICATION

This application is based upon and claims the benefit of priority from Malaysian Application No. PI 2012700119, filed Mar. 26, 2012, the entire disclosure of which is hereby incorporated by reference herein.

BACKGROUND

The present invention relates generally to the on-chip inductors in integrated circuits, more particularly to the design and construction of parallel stacked symmetrical and differential on-chip inductors.

The integration of radio-frequency (RF) functions into CMOS implementations and miniaturization has led to low cost communication solutions and has given fillip to the demand for wireless/mobile communication applications including mobile/smart phones, WIFI, Bluetooth, GPS and other applications. The performance of these applications is continuously improving. These RF implementations necessarily require inductors to be integrated on the CMOS chip and, thus, on-chip inductors continue to be the subject of research and development from early stages of RFCMOS technology. Major drawback of implementing the inductors on the CMOS chip is the relatively lower quality factor (Q). The improvement in the Q factors continues to be the subject of research till date. The implementation of on-chip inductors in the differential and/or symmetrical configurations which are used in differential circuits to suppress the common mode noise and improved Q factor is frequently used in RF CMOS integrated circuit designs. The research in this area is still being actively carried out as the challenge remains to design and fabricate higher Q differential inductors suitable for radio-frequency integrated circuits (RFIC) to support the wireless/mobile communication applications.

High Q inductors are mainly required in sharp cut-off frequency circuits, low noise impedance matching circuits, low phase noise oscillators, high gain circuits, etc. The higher Q is achieved by adding a thick metal layer on the top of silicon substrate and the concentric metal spirals are defined in this metal layer to implement high Q inductance. The thick metal layer, however, adds to the cost and process complexity. The alternative and relatively lower cost solution is to make use of multi-level metal layers available in standard CMOS and implementing the inductor spirals out of the parallel connected stacks of these multiple metal levels.

The challenge of designing and fabricating high Q inductors, specifically parallel stacked symmetrical and differential inductors, is to improve the Q factor while maintaining the inductance value, self resonance frequency and other symmetrical and differential performance parameters of the inductor. In symmetrical and/or differential inductors, the spirals cross over the other spirals through bridge regions. Conductors in the bridge regions typically lie in the metal levels close to the substrate which typically have higher resistivity and thus impact Q factor.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The present invention provides a parallel stacked symmetrical and differential inductor and a method of manufacturing the same, more particularly a parallel stacked symmetrical and differential inductor with an optimized design in its bridge region. The present invention further proposes the optimized bridge design that improves the quality factor (Q) by realizing a parallel stack of conductors in the bridge region that reduces the overall resistance.

One aspect of the present invention is a parallel stacked symmetrical and differential inductor, disposed on a substrate, comprising at least one first conductive layer disposed on an insulating layer and at least one subsequent conductive layers disposed on a plurality of insulating layers stacked under the at least one first conductive layer. The at least one first conductive layer and each of the at least one subsequent conductive layers are electrically connected by a first plurality of conductive plugs in a winding region and each of the at least one subsequent conductive layers are electrically connected by a second plurality of conductive plugs in a bridge region.

The at least one first conductive layer further comprises a first and a second symmetrical winding portion comprising a plurality of concentrically arranged semi-circular traces in the winding region and a plurality of electrical winding cross-connects in the bridge region. Each winding cross-connect in the bridge region electrically connects a first end of each of the plurality of concentrically arranged semi-circular trace of the first winding portion to a first end of each of the plurality of concentrically arranged semi-circular trace of the second winding portion of the at least one first conductive layer. Each of the at least one subsequent conductive layers further comprises a third and a forth symmetrical winding portion comprising a plurality of concentrically arranged semi-circular traces in the winding region and a plurality of electrical bridge cross-connects in the bridge region. Each bridge cross-connect in the bridge region electrically connects a second end of each of the plurality of concentrically arranged semi-circular trace of the first winding portion of the at least one first conductive layer and the third winding portion of the at least one subsequent conductive layers, to a second end of each of the plurality of concentrically arranged semi-circular trace of the second winding portion of the at least one first conductive layer and the forth winding portion of the plurality of subsequent conductive layers.

In one embodiment of the present invention, the at least one first conductive layer comprises only one conductive layer.

In another embodiment of the present invention, the at least one first conductive layer comprises a plurality of conductive layers.

In yet another embodiment of the present invention, the parallel stacked symmetrical and differential inductor further comprises at least one subsequent bridge layers disposed on at least one insulating layers stacked under the at least one subsequent conductive layers in the bridge region, characterized in that each of the at least one subsequent bridge layer are electrically connected by a third plurality of conductive plugs in the bridge region.

Another aspect of the present invention is a method of manufacturing a parallel stacked symmetrical and differential inductor, disposed on a substrate, comprising forming at least one first conductive layer disposed on an insulating layer and at least one subsequent conductive layers disposed on a plurality of insulating layers stacked under the at least one first conductive layer. The at least one first conductive layer and each of the at least one subsequent conductive layers are electrically connected by a first plurality of conductive plugs in a winding region and each of the at least one subsequent conductive layers are electrically connected by a second plurality of conductive plugs in a bridge region.

The at least one first conductive layer is formed to further comprise a first and a second symmetrical winding portion comprising a plurality of concentrically arranged semi-circular traces in the winding region and a plurality of electrical winding cross-connects in the bridge region. Each winding cross-connect in the bridge region electrically connects a first end of each of the plurality of concentrically arranged semi-circular trace of the first winding portion to a first end of each of the plurality of concentrically arranged semi-circular trace of the second winding portion of the at least one first conductive layer. Each of the at least one subsequent conductive layers further comprises a third and a forth symmetrical winding portion comprising a plurality of concentrically arranged semi-circular traces in the winding region and a plurality of electrical bridge cross-connects in the bridge region. Each bridge cross-connect in the bridge region electrically connects a second end of each of the plurality of concentrically arranged semi-circular trace of the first winding portion of the at least one first conductive layer and the third winding portion of the at least one subsequent conductive layers, to a second end of each of the plurality of concentrically arranged semi-circular trace of the second winding portion of the at least one first conductive layer and the forth winding portion of the plurality of subsequent conductive layers.

In one embodiment of the present invention, the at least one first conductive layer is formed to comprise only one conductive layer.

In another embodiment of the present invention, the at least one first conductive layer is formed to comprise a plurality of conductive layers.

In yet another embodiment of the present invention, the method further comprises forming at least one subsequent bridge layers disposed on at least one insulating layers stacked under the at least one subsequent conductive layers in the bridge region, characterized in that each of the at least one subsequent bridge layer are electrically connected by a third plurality of conductive plugs in the bridge region.

The present invention consists of features and a combination of parts hereinafter fully described and illustrated in the accompanying drawings, it is being understood that various changes in the details may be made without departing from the scope of the invention or sacrificing any of the advantages of the present invention.

DESCRIPTION OF THE DRAWINGS

To further clarify various aspects of some embodiments of the present invention, a more particular description of the invention will be rendered by references to specific embodiments thereof, which are illustrated, in the appended drawings. It is appreciated that these drawings depict only typical embodiments of the invention and are therefore not to be considered limiting of its scope. The invention will be described and explained with additional specificity and detail through the accompanying drawings in which.

DETAILED DESCRIPTION

The present invention relates to a parallel stacked symmetrical and differential inductor with an optimized design of its bridge region and method of manufacturing the same. Hereinafter, this specification will describe the present invention according to the preferred embodiments of the present invention. However, it is to be understood that limiting the description to the preferred embodiments of the invention is merely to facilitate discussion of the present invention and it is envisioned that those skilled in the art may devise various modifications and equivalents without departing from the scope of the appended claims.

The present invention provides a parallel stacked symmetrical and differential inductor with an optimized design of the bridge region and a method of manufacturing the same. The optimized design of the bridge region realizes high conductivity in the bridge region by introducing parallel stacks of available conductor layers in the manufacturing process technology that reduces the overall resistance and therefore improves the quality factor (Q) of the silicon-based on-chip inductor.

The optimized design of the bridge region according to the present invention improves the Q factor while maintaining the inductance value, self resonance frequency and other symmetrical and differential performance parameters of the inductor. The method of manufacturing to accommodate the optimized design of the bridge region requires only layout modification and does not require any additional masks or fabrication steps over and above the generic steps within the method of manufacturing conventional parallel stacked symmetrical and differential inductor.

Figure 1A:
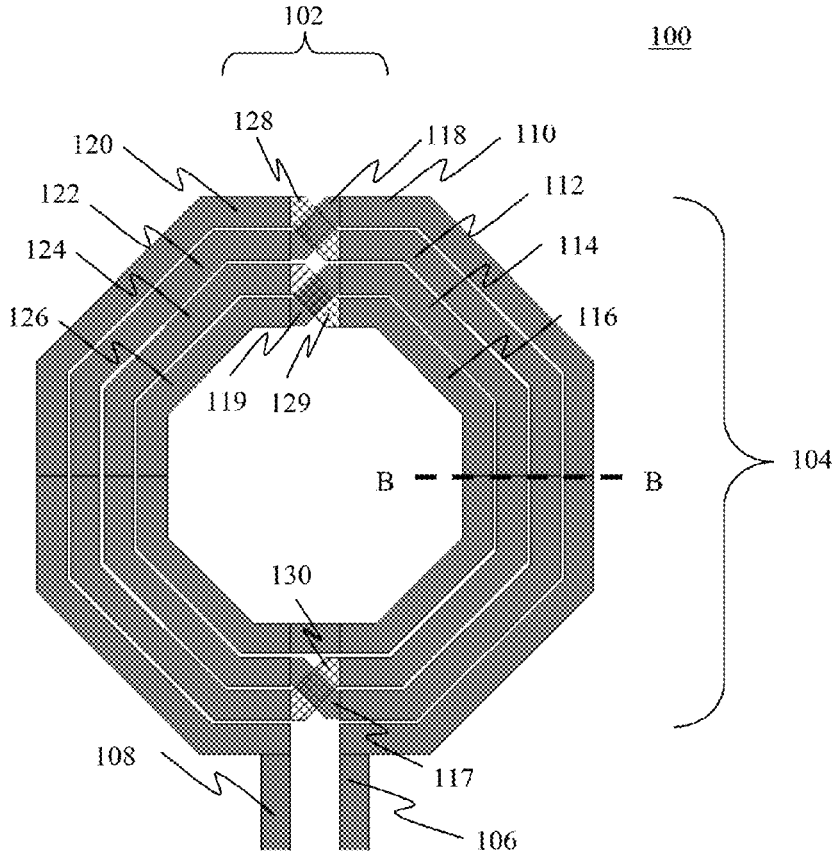
FIG. 1A is a plan view of an exemplary embodiment of the parallel stacked symmetrical and differential inductor according to the present invention.
Figure 1B:
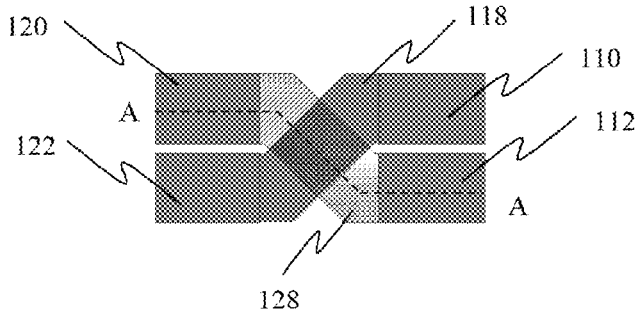
FIG. 1B is a plan view of an exemplary embodiment of the bridge region.
Figure 2A:
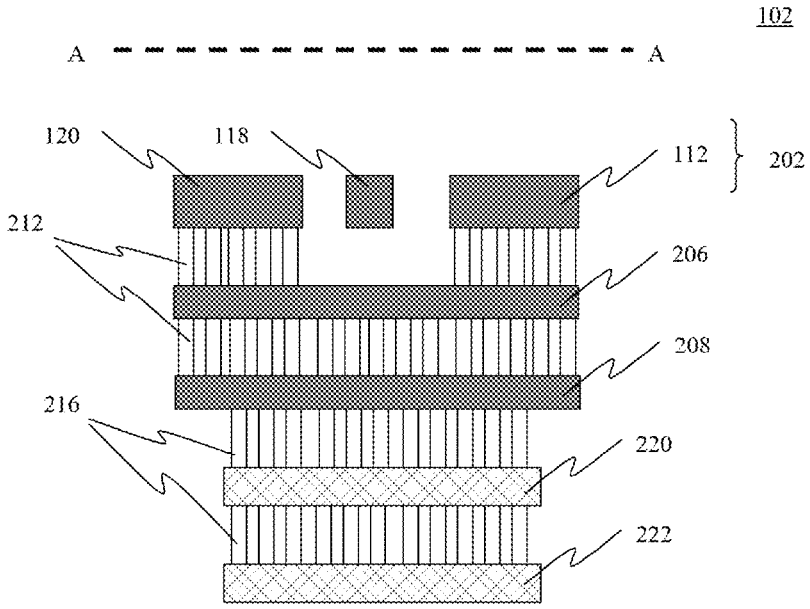
FIG. 2A is a cross-sectional view along A-A line of FIG. 1B illustrating the bridge region in one embodiment of the present invention.
Figure 2B:
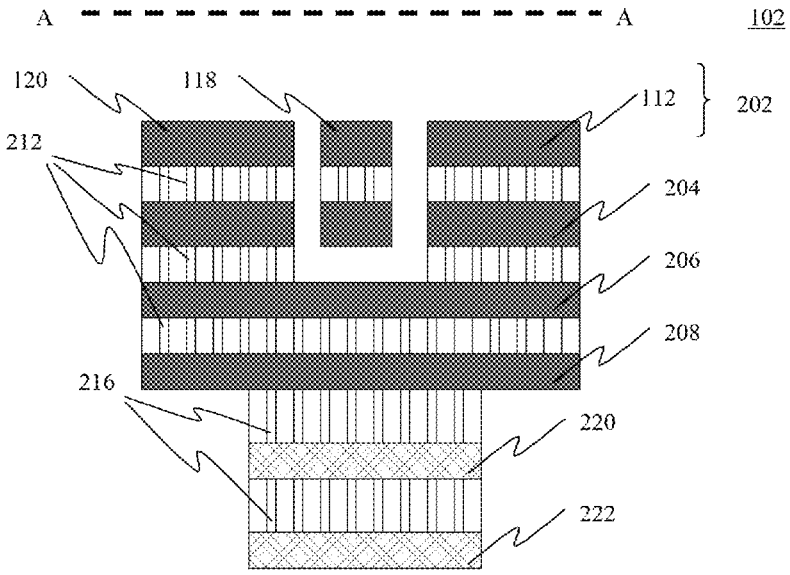
FIG. 2B is a cross-sectional view along A-A line of FIG. 1B illustrating the bridge region in another embodiment of the present invention.
Figure 2C:
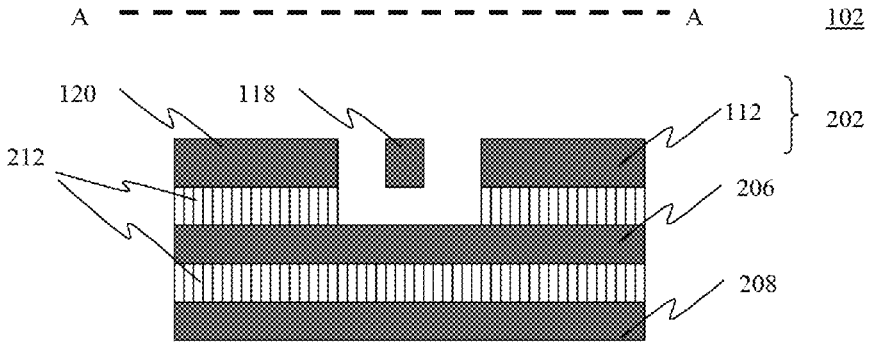
FIG. 2C is a cross-sectional view along A-A line of FIG. 1B illustrating the bridge region in yet another embodiment of the present invention.
Figure 3:
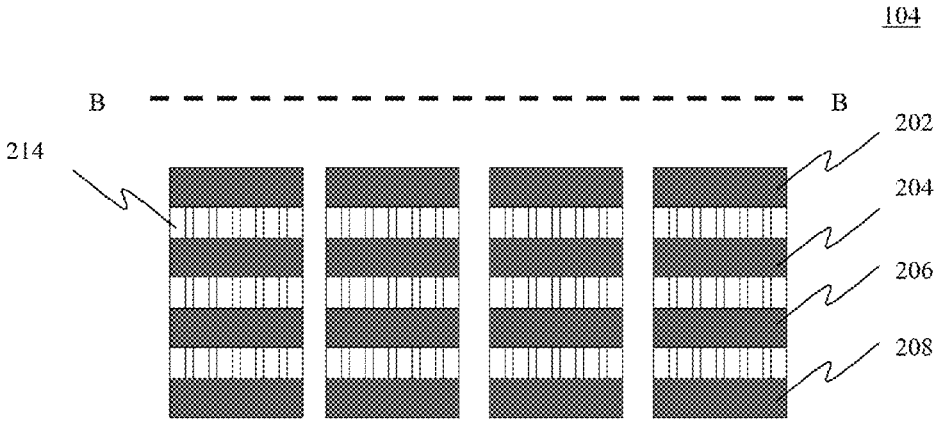
FIG. 3 is a cross-sectional view along B-B line of FIG. 1A illustrating the winding region.

FIGS. 1A, 1B, 2A, 2B, 2C and 3 are referred to collectively. FIG. 1A is a plan view of an exemplary embodiment of the parallel stacked symmetrical and differential inductor according to the present invention. FIG. 1B is a plan view of an exemplary embodiment of the bridge region. FIG. 2A is a cross-sectional view along A-A line of FIG. 1B illustrating the bridge region in one embodiment of the present invention. FIG. 2B is a cross-sectional view along A-A line of FIG. 1B illustrating the bridge region in another embodiment of the present invention. FIG. 2C is a cross-sectional view along A-A line of FIG. 1B illustrating the bridge region in yet another embodiment of the present invention. FIG. 3 is a cross-sectional view along B-B line of FIG. 1A illustrating the winding region.

The term "forming" used herein refers to conventional semiconductor deposition of photo resists, hard and/or soft masking photolithography, etching, striping and other related fabrication steps.

According to the present invention, the parallel stacked symmetrical and differential inductor is disposed on a substrate, a material such as silicon. The inductor comprises at least one first conductive layer 202, 204 disposed on an insulating layer and at least one subsequent conductive layers 206, 208 disposed on a plurality of insulating layers stacked in parallel under the at least one first conductive layer 202, 204. The at least one first conductive layer 202, 204 may be referred to as top conductive or metal layer. The at least one first conductive layer 202, 204 is generally thicker than the subsequent conductive layers 206, 208 and hence it has a lower resistance. The at least one first conductive layer 202, 204 may comprise only one conductive layer 202 or a plurality of conductive layers 202, 204. Depending on the design requirements, the resistance of the first conductor layer can be further reduced by stacking parallel layers to the conductive layer 202.

The method of manufacturing comprises forming the at least one first conductive layer 202, 204 disposed on the insulating layer and forming the at least one subsequent conductive layers 206, 208 disposed on the plurality of insulating layers stacked in parallel under the at least one first conductive layer 202, 204. Reference is being made to FIG. 1A. FIG. 1A illustrates the plan view of a four-turn parallel stacked symmetrical and differential inductor. The plan view of the parallel stacked symmetrical and differential inductor may be separated into two main parts i.e., a bridge region 102 and a winding region 104.

Reference is made to FIG. 3. The winding region 104 viewed along B-B line of FIG. 1A illustrates that the first conductive layer 202, 204 and each of the subsequent conductive layers 206, 208 are electrically connected by a first plurality of conductive plugs 214. The plurality of conductive plugs 214 comprises connecting vias.

Reference is made to FIG. 2A. The bridge region 102 viewed along A-A line of FIG. 1B illustrates that in one embodiment of the present invention, the first conductor layer in the bridge region comprises only one conductive layer 202 and each of the subsequent conductive layers 206, 208 are electrically connected by a second plurality of conductive plugs 212 in the bridge region 102. The plurality of conductive plugs 212 comprises connecting vias.

Reference is made to FIG. 2B. The bridge region 102 viewed along A-A line of FIG. 1B illustrates that in another embodiment of the present invention, the first conductor layer in the bridge region may comprise a plurality of conducting layers 202, 204 and each of the subsequent conductive layers 206, 208 are electrically connected by the second plurality of conductive plugs 212 in the bridge regions 102. The plurality of conductive plugs 212 comprise connecting vias.

Reference is made to FIG. 2C. The bridge region 102 viewed along A-A line of FIG. 1B illustrates that in yet another embodiment of the present invention, the bridge region 102 may comprise only the subsequent conducting layers 206, 208 which are electrically connected by the second plurality of conductive plugs 212 in the bridge regions 102. The plurality of conductive plugs 212 comprises connecting vias.

The first conductive layer 202, 204 further comprises a first winding portion comprising a plurality of concentrically arranged semi-circular traces 110, 112, 114, 116 in the winding region 104 and a second winding portion comprising a plurality of concentrically arranged semi-circular traces 120, 122, 124, 126 in the winding region 104. The outer-most traces 110, 120 of the first and second winding portion have laterally extending portions 106, 108 for inputting and/or outputting signals, also known as input/output terminals. The first and second winding portion in combination form a single turn on the inductor and are symmetrical with respect to the input/output terminals 106, 108. The semi-circular traces 110, 112, 114, 116, 120, 122, 124, 126 may be fabricated as circular, rectangular, hexagonal, octagonal or any other polygonal-shaped traces. Each semi-circular trace within the winding region 104 comprises a first end and a second end that continues into cross-connections within the bridge region 102. These cross-connections may either be a direct connection to a winding cross-connect on the first conductive layer 202, 204 or by way of connecting vias to a bridge cross-connect on subsequent conductive layers 206, 208.

The first conductive layer 202, 204 also further comprises a plurality of electrical winding cross-connects 118, 119 in the bridge region 102. The winding cross-connect 117, 118, 119 in the bridge region 102 electrically connects a first end of each of the plurality of concentrically arranged semi-circular trace 112, 110, 114 of the first winding portion to a first end of each of the plurality of concentrically arranged semi-circular trace 124, 122, 126 of the second winding portion of the first conductive layer 202, 204.

The winding cross-connect 117 in the bridge region 102 electrically connects the first end of semi-circular trace 112 of the first winding portion to the first end of semi-circular trace 124 of the second winding portion of the first conductive layer 202, 204. The winding cross-connect 118 in the bridge region 102 electrically connects the first end of semi-circular trace 110 of the first winding portion to the first end of semi-circular trace 122 of the second winding portion of the first conductive layer 202, 204. The winding cross-connect 119 in the bridge region 102 electrically connects the first end of semi-circular trace 114 of the first winding portion to the first end of semi-circular trace 126 of the second winding portion of the first conductive layer 202, 204.

Each of the subsequent conductive layers 206, 208 further comprises a third and a forth winding portion comprising a plurality of concentrically arranged semi-circular traces in the winding region 104. The third and forth winding portion of subsequent conductive layers 206, 208 are stacked in parallel below the first and second winding portion of the first conductive layer 202, 204. Therefore, the third and forth winding portion of subsequent conductive layers 206, 208 in combination also form a single turn on the inductor and are symmetrical to one another. The semi-circular traces may be fabricated as circular, rectangular, hexagonal, octagonal or any other polygonal-shaped traces.

Each of the subsequent conductive layers 206, 208 also further comprises a plurality of electrical bridge cross-connects 128, 129, 130 in the bridge region 102. Each bridge cross-connect 128, 129, 130 in the bridge region 102 electrically connects a second end of each of the plurality of concentrically arranged semi-circular trace 112, 116, 114 of the first winding portion of the first conductive layer 202, 204 and the third winding portion of the plurality of subsequent conductive layers 206, 208, to a second end of each of the plurality of concentrically arranged semi-circular trace 120, 124, 122 of the second winding portion of the first conductive layer 202, 204 and the forth winding portion of the plurality of subsequent conductive layers 206, 208.

The bridge cross-connect 130 electrically connects the second end of semi-circular trace 114 of the first winding portion on the first conductive layer 202, 204 and the third winding portion on the plurality of subsequent conductive layers 206, 208, to the second end of semi-circular trace 122 of the second winding portion on the first conductive layer 202, 204 and the forth winding portion on the plurality of subsequent conductive layers 206, 208. The bridge cross-connect 128 electrically connects the second end of semi-circular trace 112 of the first winding portion on the first conductive layer 202, 204 and the third winding portion on the plurality of subsequent conductive layers 206, 208, to the second end of semi-circular trace 120 of the second winding portion on the first conductive layer 202, 204 and the forth winding portion on the plurality of subsequent conductive layers 206, 208. The bridge cross-connect 129 electrically connects the second end of semi-circular trace 116 of the first winding portion on the first conductive layer 202, 204 and the third winding portion on the plurality of subsequent conductive layers 206, 208, to the second end of semi-circular trace 124 of the second winding portion on the first conductive layer 202, 204 and the forth winding portion on the plurality of subsequent conductive layers 206, 208.

This optimized design of the bridge region 102 entails that the subsequent conductive layers 206, 208 in the winding region 104 define the "under pass" of the bridge region 102. The first conductive layer 202, 204 continues to remain the part of the winding region 104 directly above the bridge region 102. This realizes a thick conductor within the bridge region 102, hence reducing the resistance of the bridge region 102. The increase in the resistance of the winding region 104 directly above the bridge region 102 is less significant as the first conductive layer 202, 204 is generally thicker than the subsequent conductive layers 206, 208.

In another embodiment of the present invention, the bridge region 102 may further comprise a plurality of subsequent bridge layers 220, 222 disposed on a plurality of insulating layers stacked under the plurality of subsequent conductive layers 206, 208. The plurality of subsequent bridge layers 220, 222 are stacked in parallel under the plurality of subsequent conductive layers 206, 208 in bridge region 102 to further reduce the resistance of the bridge region 102.

While illustrative embodiments have been illustrated and described, it will be appreciated that various changes can be made therein without departing from the spirit and scope of the invention.

The embodiments of the invention in which an exclusive property or privilege is claimed are defined as follows:

1. A parallel stacked symmetrical and differential inductor, disposed on a substrate, comprising:

a first conductive layer disposed on a first insulating layer;

more than one subsequent conductive layers, each of the more than one subsequent conductive layers disposed on a corresponding one of more than one subsequent insulating layers stacked under the first conductive layer;

wherein the first conductive layer and the more than one subsequent conductive layers are electrically connected by a first plurality of conductive plugs in a winding region; and each of the more than one subsequent conductive layers are electrically connected by a second plurality of conductive plugs in a bridge region;

wherein, the first conductive layer comprises a first winding portion and a second winding portion, each winding portion comprising a plurality of nested traces in the winding region, and a plurality of electrical winding cross-connects in the bridge region; and wherein, the more than one subsequent conductive layers comprise a third winding portion and a fourth winding portion, each winding portion comprising a plurality of nested traces in the winding region and a plurality of electrical bridge cross-connects in the bridge region;

further comprising a bridge conductive layer on a bridge insulating layer stacked under the more than one subsequent conductive layers wherein the bridge conductive layer is electrically connected to the more than one subsequent conductive layers by a third plurality of conductive plugs in the bridge region, wherein the bridge conductive layer is disposed only in the bridge region.

2. The parallel stacked symmetrical and differential inductor according to claim 1 wherein, each winding cross-connect in the bridge region electrically connects a first end of one of the plurality of nested traces of the first winding portion to a first end of one of the plurality of nested traces of the second winding portion.

3. The parallel stacked symmetrical and differential inductor according to claim 2 wherein, each of the plurality of bridge cross-connects in the bridge region electrically connects a second end of one of the plurality of nested traces of the first winding portion and the third winding portions of the more than one subsequent conductive layers, to a second end of one of the plurality of nested traces of the second winding portion and the fourth winding portions of the at least more than one subsequent conductive layer.

4. The parallel stacked symmetrical and differential inductor according to claim 1 wherein, the first conductive layer comprises a plurality of conductive layers.

5. The parallel stacked symmetrical and differential inductor according to claim 1, wherein the bridge conductive layer comprises a plurality of conductive layers.

* * * * *

UNITED STATES PATENT AND TRADEMARK OFFICE

CERTIFICATE OF CORRECTION

PATENT NO. : 9,111,676 B2
APPLICATION NO. : 13/797073
DATED : August 18, 2015
INVENTOR(S) : C. L. Ler et al.

It is certified that error appears in the above-identified patent and that said Letters Patent is hereby corrected as shown below:

In the Claims

| COLUMN | LINE | ERROR |
|---|---|---|
| 8 (Claim 3, | 37 line 8) | "at least more than" should read --more than-- |

Signed and Sealed this
Fifth Day of July, 2016

Michelle K. Lee

Michelle K. Lee
*Director of the United States Patent and Trademark Office*